US008367956B2

(12) United States Patent
Hoess et al.

(10) Patent No.: US 8,367,956 B2
(45) Date of Patent: Feb. 5, 2013

(54) THUMBWHEEL

(75) Inventors: Stefan Hoess, Leutkirch (DE); Michael Hetzer, Isny-Bolsternang (DE)

(73) Assignee: Elobau GmbH & Co. KG, Leutkirch (DE)

( * ) Notice: Subject to any disclaimer, the term of this patent is extended or adjusted under 35 U.S.C. 154(b) by 300 days.

(21) Appl. No.: 12/828,873

(22) Filed: Jul. 1, 2010

(65) Prior Publication Data

US 2011/0032058 A1 Feb. 10, 2011

(30) Foreign Application Priority Data

Aug. 6, 2009 (DE) ..... 10 2009 036 318

(51) Int. Cl.
*H01H 9/00* (2006.01)

(52) U.S. Cl. ..... 200/316; 200/310; 200/313; 200/317; 335/205

(58) Field of Classification Search ..... 335/205–207; 200/61.27–61.39, 310–317, DIG. 47
See application file for complete search history.

(56) References Cited

U.S. PATENT DOCUMENTS

| | | | | |
|---|---|---|---|---|
| 5,359,165 | A * | 10/1994 | Leveque et al. | 200/317 |
| 6,545,576 | B1 * | 4/2003 | Marchini et al. | 335/205 |
| 7,105,759 | B1 * | 9/2006 | Mucha | 200/310 |
| 7,514,643 | B1 * | 4/2009 | Tittle | 200/314 |

FOREIGN PATENT DOCUMENTS

| | | |
|---|---|---|
| EM | 001085062 | 2/2009 |
| EP | 1246040 | 10/2002 |
| EP | 1288763 | 3/2003 |

* cited by examiner

*Primary Examiner* — Ramon Barrera
(74) *Attorney, Agent, or Firm* — Notaro, Michalos & Zaccaria P.C.

(57) ABSTRACT

An electric switch for use on multiple-use operating elements in commercial vehicles has an operating part that performs a rotational movement around a limited angle and can be actuated directly by a solid body outside the switch, and having a support housing and an adjustment wheel having the operating part. In order to enable a safe usability in the dark, the operating part is constructed in an illuminated manner dependent on the operating position.

10 Claims, 2 Drawing Sheets

THUMBWHEEL

FIELD AND BACKGROUND OF THE INVENTION

The present invention relates to an electric switch for use on multiple-use operating elements in the commercial vehicles sector, the operating part of which performs a rotational movement around a limited angle and can be actuated directly by means of a solid body outside of the switch.

Electric switches in motor vehicles and particularly in commercial vehicles must also be reliably operable and provide switching state information to the operator in the dark. For this reason, button switches in motor vehicles have for a long time been illuminated. In commercial vehicles, multiple-use operating elements are often present, which enable a plurality of switching functions with one hand and for example are structured as a multiple-function handle or joystick with a plurality of switches. As a result, both the movement of the entire hand and the movement of individual fingers of an operator can be used for the actuation of functions of the commercial vehicle, without the hand having to be taken away from the multiple-use operating element. This increases the efficiency of the commercial vehicle and the safety for the operator. Generally, a plurality of electric switches which are to be operated with individual fingers are provided on these multiple-use operating elements. EP 1 246 040 describes a multiple-function handle with individual pressure switches for earth moving machines such as excavators. EP 1 288 763 describes a multiple-function handle for an agricultural vehicle such as a combine harvester which has button switches exclusively.

Switches to be operated with one finger, particularly thumbs, and pivoted around a certain angle are likewise known as such.

It is disadvantageous for this prior art however, that switches of this type cannot be not operated operationally reliably in the customary manner at night.

SUMMARY OF THE INVENTION

It is therefore the object of the present invention to specify an electric switch for which the operational reliability is even guaranteed in the dark.

This object is achieved in that the operating part is constructed in an illuminated manner, particularly in a manner dependent on position, preferably in a different colour in a manner dependent on position. With great advantage, the present invention provides an illuminated rotary switch which can be rotated about a limited angle, which rotary switch reliably shows the user the current position and therefore the switching state by means of light even in the dark or in poor light conditions. Here, it is particularly advantageous if the switch is not only illuminated as such but this illumination is constructed in a manner dependent on the operating position, that is to say is differently constructed depending on the operating position. The operator can therefore determine in which operating position the rotary switch according to the invention is located at a particular point in time simply by means of a click. The switch according to the invention is in this case provided for operation by means of a thumb or an index finger of an operator, wherein it is in the first case arranged on the front side of a multiple-function handle and on the other hand on the rear side of the multiple-function handle.

According to the invention, it is provided that the operating part has a neutral and two or more operating positions, particularly an upper and a lower stop with neutral middle position arranged therebetween. According to the invention, more than two operating positions, for example four operating positions with neutral middle position, are also conceivable according to the invention. Depending on the use purpose, a neutral end position and differently illuminated operating positions adjacent thereto is of course also conceivable. This always makes sense if operating processes should be controlled with this switch, which must always be completed in the same sequence, so that the second, third, etc. step follows the one operating step, if appropriate also again in the reverse sequence back to the start or neutral position. According to the invention, the configurations of the switch as a push switch with reset or as described as latching switches with a plurality of switch positions or combinations thereof.

As a result of the fact that the illumination of the operating part is constructed using at least one optical waveguide independently of its mechanical rotational movement, the structure of the switch according to the invention and also its operational reliability is advantageously increased. The optical waveguide is in this case to be provided according to the invention in order to guide the light of a light source to the operating part and from there allow it to escape outside. The optical waveguide allows the decoupling, with great advantage, of mechanical rotational movement and location of the light creation, so that no cable or the like has to be entrained during the mechanical rotational movement. The optical waveguide is in this case constructed in such a manner that it is constructed in a manner accommodating light of one or a plurality of light sources at one and/or a plurality of locations spatially distanced from one another and forwarding it to the operating part. The optical waveguide according to the invention therefore has a discharge end and a light-collection side, for example in the form of a T curved and rotated by 180° in terms of its installation position. Due to this spatial large light-collection side according to the invention, light sources emitting differently coloured light can be arranged spatially separated from one another, so that even large rotational movements still always lead to it being possible to collect, guide and emit light at the switch.

If the illumination of the switch is constructed as a single- and multi-colour background illumination, then the above indicated advantages are realised particularly simply.

In a configuration of the invention, it is provided that the support housing carries a printed circuit board, particularly an SMD-equipped printed circuit board which for its part in turn carries illumination means and that the support housing has an optical waveguide. In particular, it is provided that the printed circuit board, particularly SMD-equipped printed circuit board, is arranged in the interior of the support housing so that it is protected to the greatest possible extent from outside influences such as in particular dust and moisture and mechanical loadings. The printed circuit board carries illumination means which can according to the invention be LEDs for example, but do not have to be. The optical waveguide provided on or in the support housing collects the light of the one or the plurality of illumination means and is therefore likewise mechanically protected. According to the invention, the optical waveguide can also be part of the support housing itself.

This is particularly advantageous if the optical waveguide is formed by the support housing itself and in particular in that it is formed from transparent thermoplastic material. The use of the transparent thermoplastic material according to the invention allows a simple production of the support housing by means of injection moulding and advantageously reduces the number of parts required. In order to increase the light intensity escaping to the outside at the operating part, it can be provided according to the invention that a further optical waveguide is provided between the support housing and discharge point of the light at the operating part, so that the light emitted by the illumination means in the interior of the support housing is collected by means of the support housing and coupled into the further optical waveguide largely unchanged in terms of colour and scattering from the light output type at the operating part.

It is provided in a configuration of the invention that the operating part is arranged on a support axle of the support housing and has means for limiting the rotational movement. The operating part is used to adjust the operating state of the switch, this takes place in the simplest manner from a design point of view in that it is arranged on a central coaxial support axle of the support housing. If it has means for limiting the rotational movement, then incorrect operation of the switch according to the invention can be prevented, as mechanical forces cannot be exerted excessively. Particularly if a return spring is provided for resetting the defected operating part into its rest position between support housing and adjustment wheel, then the restoring force can be applied particularly easily.

If a wheel cover is fixed on the operating part, particularly a wheel cover snapped onto the operating part, wherein an optical waveguide is preferably provided and held between wheel cover and operating part, then a particularly efficient constructively simple and permanent solution is enabled.

Particularly advantageous from an electrical engineering point of view is the construction of the switch as a contactless switch, particularly a Hall effect switch or reed switch, as this reduces the number of parts required and at the same time allows a switch which is as operationally reliable and long lasting as possible.

It is particularly advantageous that in a configuration of the invention, the equipped printed circuit board is constructed in a manner in which it is protected from penetrating dust or moisture, so that its service life is not shortened even under the harsh use conditions according to the invention. According to the invention, this mechanical protection can be achieved by means of encapsulation by means of a transparent casting compound or by means of the use of a transparent adhesive for adhesively bonding the printed circuit board. This leads with great advantage to a switch with high IP class, for example a class lying above IP67, as is particularly desirable in the case of use in commercial vehicles such as excavators, combine harvesters or tractors.

DESCRIPTION OF THE DRAWINGS

The invention is described in a preferred embodiment with reference to a drawing by way of example, wherein further advantageous details are to be drawn from the figures of the drawing.

Functionally identical parts are in this case provided with the same reference symbols.

In detail, the figures show:

Figure 1:
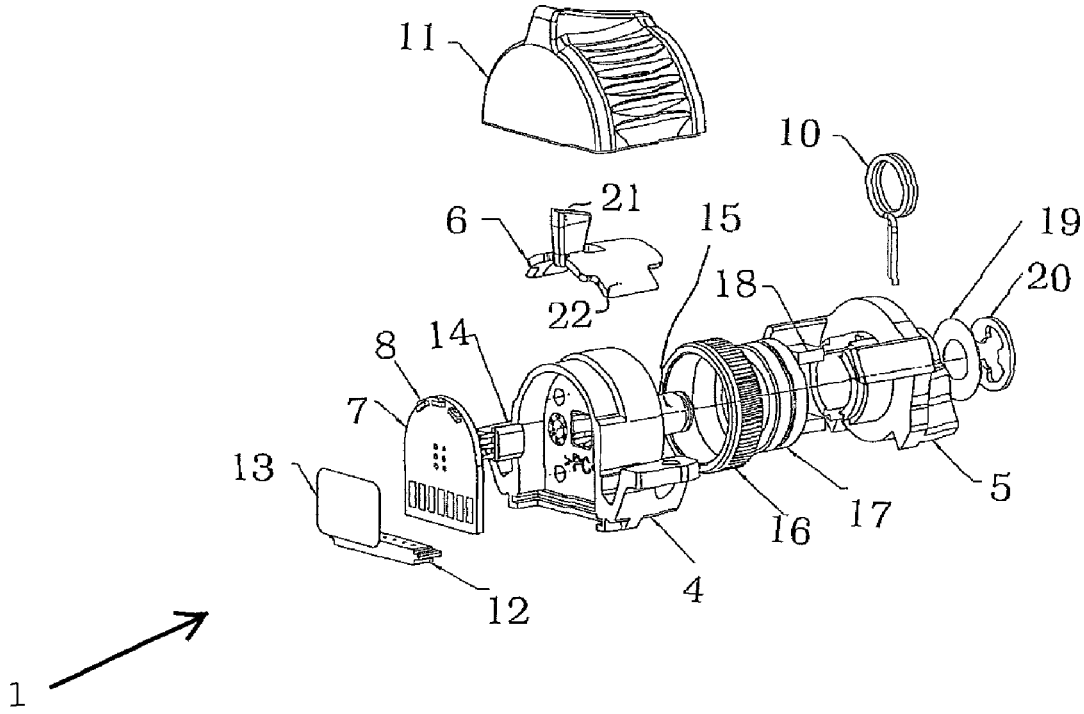

FIG. 1: shows an exploded drawing of a switch according to the invention.

FIGS. 2*a* to *d*: show components of the switch according to the invention.

DESCRIPTION OF THE PREFERRED EMBODIMENTS

FIG. 1 shows an exploded drawing of an embodiment of a switch according to the invention. The central part of the switch is the support housing 4 produced from transparent thermoplastic material. This has a coaxially arranged support axle 15 on one side and a holder for an SMD-equipped printed circuit board 7 on the other side. Illumination means 8, namely three LEDs 8, are located on the printed circuit board 7. Likewise shown are a cable gland 12 and a label 13. A Hall element 14 is located between the housing 4 and printed circuit board 7. Arranged on the other side of the housing 4 are a bearing bushing 16 and a bearing ring 17 for mounting the rotationally moveable adjustment wheel 5 and enabling its rotational movement. This rotationally moveable adjustment wheel 5 carries the magnets 18. The adjustment wheel 5 is reset by means of a leg spring 10 and secured against axial movement on the support axle 15 by means of the adjusting washer 19 and lock washer 20. Here, the support axle 15 passes through the eye of the leg spring 10. The two long arms on the upper side of the adjustment wheel 5 carry a separate optical waveguide 6 which is covered by a wheel cover 11 and the light output end 21 of which is optically accessible by means of an opening (not shown) in the operating web of the wheel cover 11. The light collection side 22 is constructed in a curved manner and covers the illumination means 8 in the mounted state. The adjustment wheel 5 is moved by means of a rotational movement of the wheel cover 11 by means of a thumb or an index finger of an operator of a multiple-function handle. This movement is recognised by control electronics arranged on the printed circuit board 7, which for their part control the corresponding illumination means 8 and cause it to illuminate. Its emitted light passes initially through the transparent casting compound or the transparent adhesive of the printed circuit board 7 to the housing 4, which for its part forwards the light and couples it into the optical waveguide 6 without changing the light intensity, phase, wavelength or colour significantly, preferably not at all. On account of the spatially largely constructed light collection end 22, the mechanical rotational movement of the adjustment wheel or element 5 does not lead to it not being possible to capture the light of the illumination means 8 by means of the optical waveguide 6 and forward it to the wheel cover 11. A certain LED 8 is controlled in dependence on the rotational movement so that its coloured light can be perceived at the light output end 21 by an operator. Each switching state of the switch according to the invention is in this case assigned a light colour so that the switching state of the switch can be recognised easily. Whether the switch is in this case constructed as a button or latch switch is subordinate to the invention as long as its switching states can be optically recognised clearly and easily.

Figure 2B:
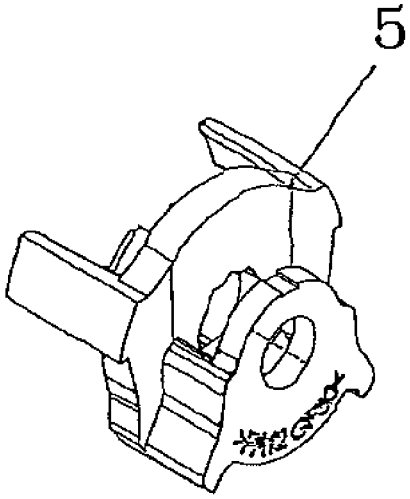
Figure 2D:
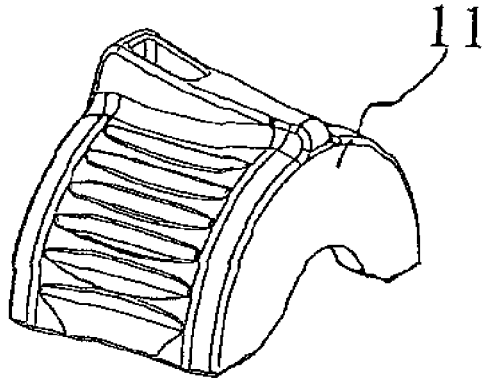
Figure 2C:
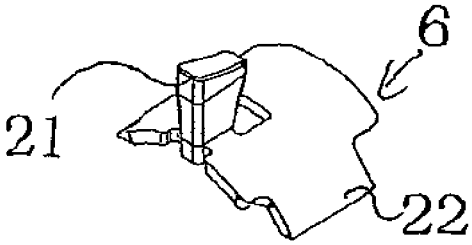
Figure 2A:
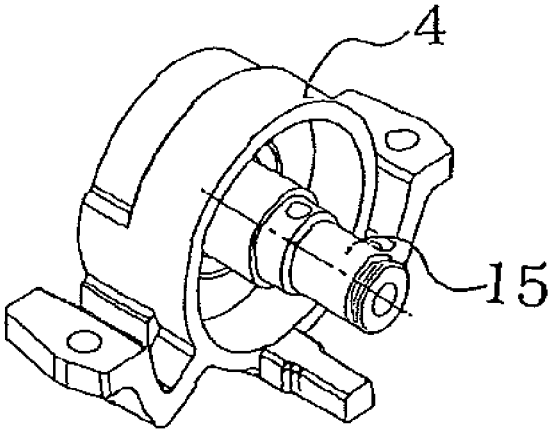

FIG. 2*a* features the construction of the support housing 4, particularly its support axle side. Two fixing flanges which extend in the manner of arms radially away from the support housing 4 are to be recognised. The support axle 15 has a groove in the region of its free end which is used for accommodating an adjusting washer 19 and a lock washer 20. The section of the support axle 15 extending onto the groove on the housing side is used for accommodating the adjustment wheel 5, wherein the adjustment wheel 5 rests both in this section and on the section which is further arranged on the support housing side and is of a relatively large diameter. Located between adjustment wheel and the part of the support housing 4 of relatively large diameter are the bearing bushing and bearing ring which are not shown here.

FIG. 2*b* shows the adjustment wheel 5 with two apertures which differ in terms of diameter and through which the support axle 15 passes in each case. Likewise to be recognised are the two rotational angle limiters which extend radially outwards and in the process point in the direction of the free end of the support axle 15. The two sections with the through hole form an accommodating pocket for a leg spring 10, the eye of which is arranged coaxially to the two apertures. Two relatively long arms are shown in the upper region of the adjustment wheel 5, which point in the direction of the housing 4 and hold the optical waveguide 6 in accordance with FIG. 2*c*. This has a light collection section 22, which is shaped in the manner of a cylinder jacket section, and a light output end 21. The wheel cover 11 is in this case clipped over the optical waveguide 6 onto the adjustment wheel 5 in such a manner that it cannot readily be removed. This is achieved in that two beads are formed on the inner lower side of the wheel cover 11, which grip over the longitudinal arms of the adjustment wheel so that this latches as in the wheel cover 11.

It is then provided according to the invention that the illumination means emit light on the SMD-equipped printed circuit board 7, particularly in different colour characteristics. It is particularly important here that a different light colour passes outwards through the operating part in the rest position from that at the upper or lower stop point in the case of a construction as a latch switch.

LIST OF REFERENCE SYMBOLS

1 Electric switch
Multiple-use operating element
Operating part
4 Support housing
5 Adjustment wheel
6 Optical waveguide
7 Printed circuit board
8 Illumination means
Means
10 Return spring
11 Wheel cover
12 Cable gland
13 Label
14 Hall element
15 Support axle
16 Bearing bushing
17 Bearing ring
18 Magnet
19 Adjusting washer
20 Lock washer
21 Light output end
22 Light collection side

The invention claimed is:

1. An electric switch (1) provided on a multiple-use operating element like a joystick in the commercial vehicles sector, comprising:

a support housing (4), the support housing (4) having a central coaxial support axle (15), the support housing (4) also carrying a printed circuit board (7), particularly an SMD-equipped printed circuit board (7), which in turn carries illumination means (8) and;

an actuating wheel (5), the actuating wheel (5) being mounted on the support axle (15), whereby a wheel cover (11) is fixed on the actuating wheel (5) and wherein an optical waveguide (6) is provided and held between wheel cover (11) and actuating wheel (5), whereby actuating wheel (5) and wheel cover (11) forming an operating part (3) of the switch (1);

wherein the switch (1) is operational with one finger, particularly a thumb, of an operator's hand having gripped the joystick; and wherein the optical waveguide (6) has a spatial large light collection section (22) being shaped in a manner of a cylinder jacket section and a single discharge end (21), whereby the light collection section (22) covers the illumination means (8) in a mounted stage, such that even large rotational movements still lead to it being possible to collect, guide and emit light at the discharge end (21) and whereby the discharge end (21) ends in an opening of the wheel cover (11)

such that the operating part (3) is illuminated in different colors depending on the switching status of the switch (1).

2. The switch according to claim 1, wherein the operating part (3) has a neutral and two or more operating positions.

3. The switch according to claim 1, wherein the illumination of the operating part (3) is constructed using at least one optical waveguide (6) independently of its mechanical rotational movement.

4. The switch according to claim 1, wherein the illumination of the switch (1) is constructed as a single- or multicolour background illumination.

5. The switch according to claim 1, wherein the the support housing (4) is formed from transparent thermoplastic material.

6. The switch according to claim 1, wherein the actuating wheel (5) has means (9) for limiting the rotational movement of the adjustment wheel (5).

7. The switch according to claim 1, wherein a return spring (10) is provided for resetting the deflected actuating wheel (5) into a rest position.

8. The switch according to claim 1, wherein the wheel cover (11) snapped onto the actuating wheel (5).

9. The switch according to claim 1, wherein the switch (1) is constructed as a contactless switch (1), particularly is constructed as a Hall effect switch or reed switch (1).

10. The switch according to claim 1, wherein the printed circuit board (7) is constructed in a manner mechanically protected from penetrating water, particularly is encapsulated by means of transparent casting compound or is adhesively bonded by means of transparent adhesive.

* * * * *